United States Patent [19]

Suck

[11] Patent Number: 4,899,063

[45] Date of Patent: Feb. 6, 1990

[54] POWER WINDOW SWITCH FOR AN AUTOMOBILE

[76] Inventor: Yoon-Gi Suck, Sinbanpo 7th Apartment 301-608, 130-17, Chamwon-Dong, Seocho-Ku, Seoul, Rep. of Korea

[21] Appl. No.: 225,920

[22] Filed: Jul. 29, 1988

[30] Foreign Application Priority Data

May 13, 1988 [KR] Rep. of Korea ..... 88-5607

[51] Int. Cl.[4] ..... H01H 13/70

[52] U.S. Cl. ..... 307/9.1; 200/5 R; 200/5 A; 200/6 R; 318/257; 318/293

[58] Field of Search ..... 307/9, 10 R, 114, 115; 318/264, 267, 266, 256, 257, 280, 282, 283, 286, 287, 290, 292, 293, 294, 434, 445, 466, 467, 468, 469, 480, 478, DIG. 2; 200/1 V, 5 R, 5 A, 5 EA, 5 EB, 5 E, 5 D, 5 C, 5 B, 6 R, 6 A, 6 B, 6 BA, 6 BB, 6 C, 4, 11 G, 27 A, 153 L, 153 K, 68.2, 72 R, 67 D, 159 A; 15/250.12, 250.13, 250.16, 250.17, 250.19

[56] References Cited

U.S. PATENT DOCUMENTS

| | | | |
|---|---|---|---|
| 3,496,441 | 2/1970 | Heider et al. | 318/294 X |
| 4,119,899 | 10/1978 | Sumida | 318/469 X |
| 4,275,340 | 6/1981 | Schleupen | 318/280 |
| 4,354,068 | 10/1982 | Sobol III | 200/5 A |
| 4,477,700 | 10/1984 | Balash et al. | 200/5 A |
| 4,508,942 | 4/1985 | Inaba | 200/5 A |
| 4,532,575 | 7/1985 | Suwa | 200/5 R X |
| 4,544,869 | 10/1985 | Pittaway | 318/257 X |
| 4,551,660 | 11/1985 | Suzuki | 318/293 |
| 4,575,589 | 3/1986 | Hoffman | 200/5 A |
| 4,590,338 | 5/1986 | Suzuki | 200/6 R X |
| 4,611,102 | 9/1986 | Ishida | 200/5 R |
| 4,611,261 | 9/1986 | Suwa | 200/5 A X |
| 4,654,488 | 3/1987 | Westfall | 200/5 R |
| 4,710,602 | 12/1987 | Baity et al. | 200/339 X |
| 4,766,271 | 8/1988 | Mitsuhashi et al. | 200/5 A x |
| 4,775,574 | 10/1988 | Fukushima et al. | 200/5 A X |

*Primary Examiner*—William M. Shoop, Jr.
*Assistant Examiner*—Paul Ip
*Attorney, Agent, or Firm*—Beveridge, DeGrandi & Weilacher

[57] ABSTRACT

A power window switch for an automobile having a switching mechanism which includes a fixed contact plate and a circuit board secured within the inside of a resinous casing, the casing including a port. Positioned above the port is a button which includes a sloped elastic portion having its outer edge secured to the casing around the port. Compression of the button's sloped elastic portion places a conductive rubber contact attached to the bottom surface of the button into contact with a fixed contact on the fixed contact plate. The circuit board includes a switching circuitry which is responsive to variations in position of the button and attached conductive rubber contact.

13 Claims, 7 Drawing Sheets

POWER WINDOW SWITCH FOR AN AUTOMOBILE

FIELD OF THE INVENTION

This invention relates to a power window switch for an automobile and particularly to a switching mechanism and circuit which guarantees a long life and an accurate operation of the switch.

BACKGROUND OF THE INVENTION

In the conventional applications of a power window switch for an automobile, an operation of a power source has been conducted by a construction of mechanical seesaw type FIGS. 1 and 2. As it were, because of direct make and break of a load using alloy contacts the excessive starting current which occurs at the initial switching causes an arc discharge when alloy contacts contact each other, and for this reason faces of a traveling contact and a fixed contact are damaged to be uneven so a contact operation becomes unstable, and repeated operations shorten the life of a switch. Besides the shortcoming above mentioned conventional mechanical power window switches have another shortcoming. Conventional switches use an elastic spring in order to return a button once pushed so the touch is not agreeable.

SUMMARY OF THE INVENTION

Accordingly the present invention has the following objects to remedy and improve disadvantages of conventional power window switches.

An important object of the present invention is to provide a switch which has a semipermanent contact by making a traveling contact of conductive rubber material through which the damage of a contact due to an arc at the initial switching can be prevented.

A further object in association with the preceding object of the present invention is to provide a switching circuit in order to prevent switching loss and to conduct accurate operation by means of a transistor switching circuitry.

Another object of the present invention is to provide a resin wall means surrounding interior components of a switch, through which a button comprising said rubber traveling contact returns to the original position smoothly when it is pushed, and through which said interior components are isolated from enviromental conditions and thereupon a desirable insulating effect as well as a desirable moisture-proof effect can be obtained.

In accordance with the present invention a power window switch comprises an elestic resin wall having buttons protruded therefrom of which the lower part is a conductive rubber contact; a fixed contact electrically and elastically contacted with said conductive rubber contact; and a PCB (printed circuit board) on the base of said resin wall.

The present invention will be described in more detail with reference to the accompanying drawings.

BRIEF DESCRIPTION OF THE DRAWINGS

FIG. 1 is a perspective view thereof and

FIG. 2 is a partial, cross-sectional, side, elevational view of contacts showing a contact relation;

FIG. 7 is a perspective view thereof, and

FIG. 8 is a schematic circuit diagram;

FIG. 9 is a perspective view thereof, and

FIG. 10 is a schematic diagram;

DETAILED DESCRIPTION OF THE INVENTION

Figure 1:
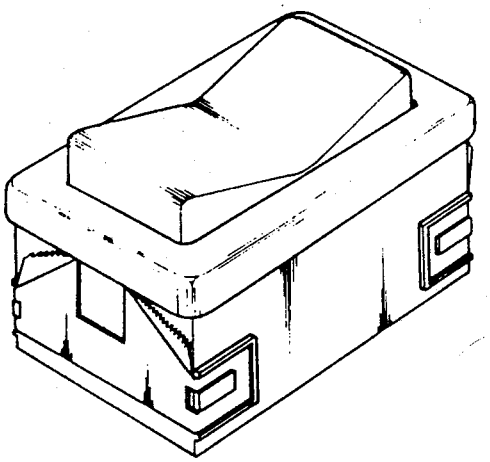
FIGS. 1 and 2 represent a conventional power switch for an automobile.
Figure 2:
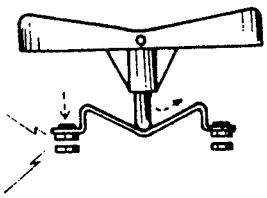
Figure 3:
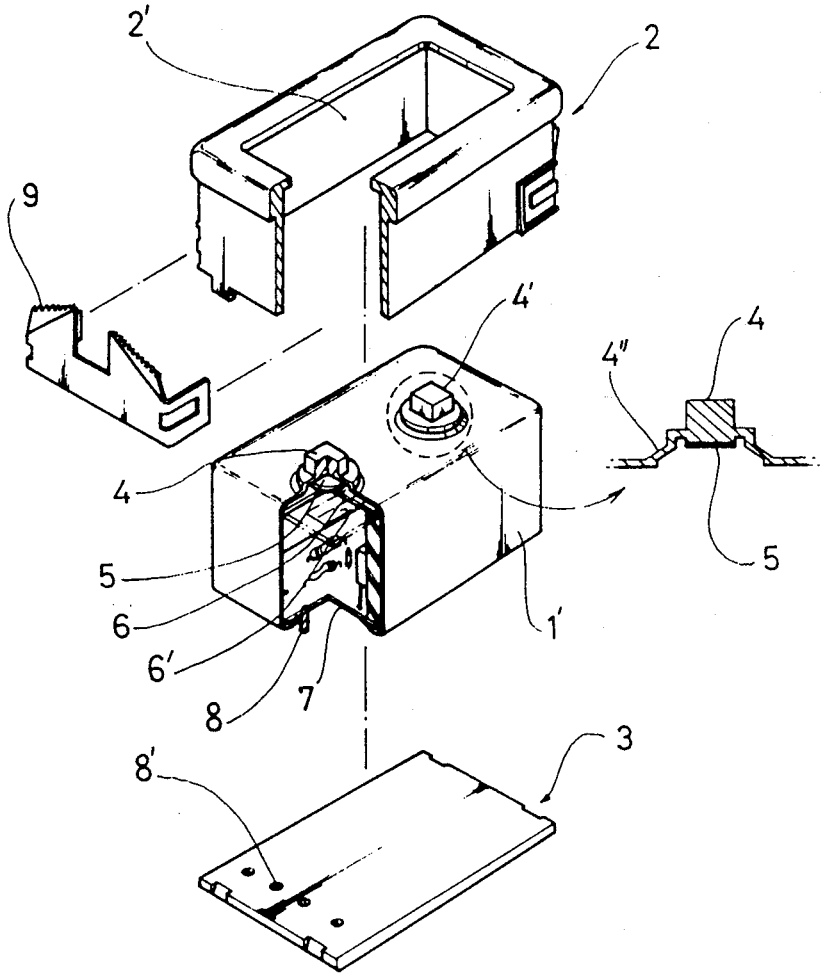
FIG. 3 is a partial exploded perspective view of the first embodiment according to the present invention and a cross-sectional, side, elevational view of the button part.
Figure 4:
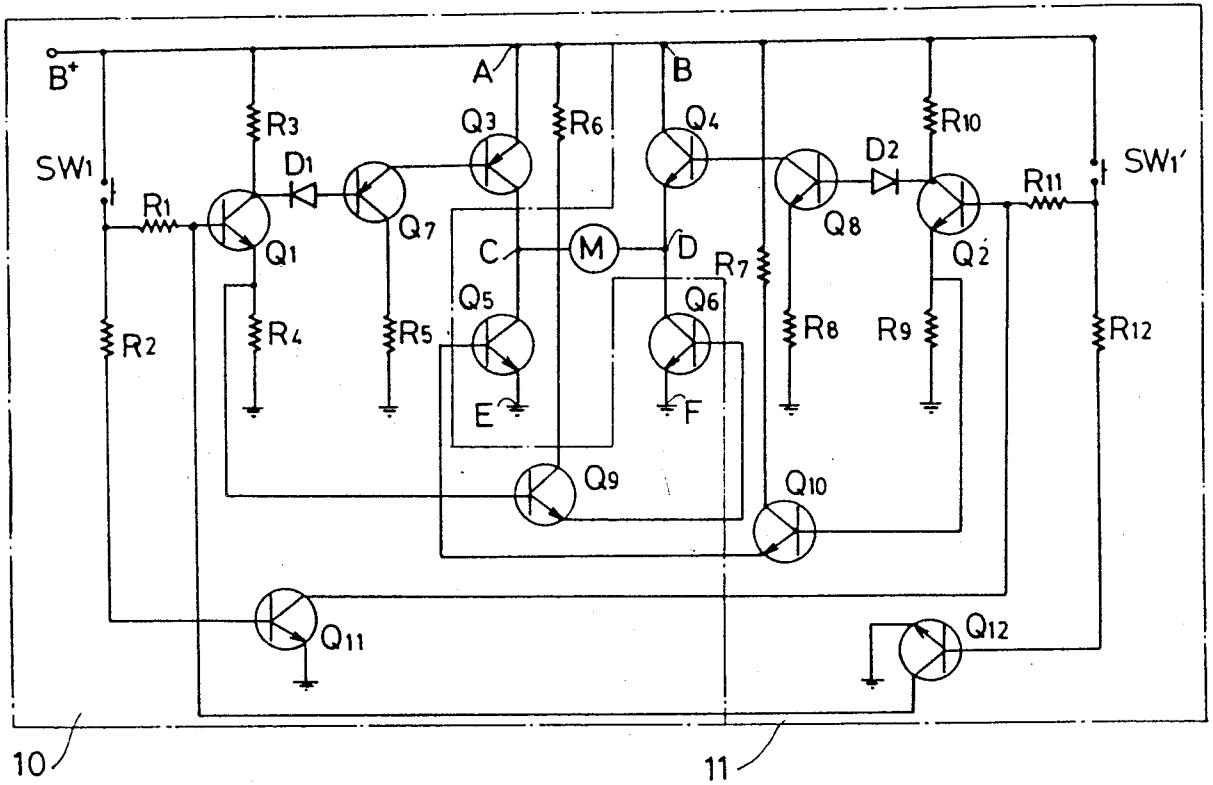
FIG. 4 is a circuit diagram applying to the first embodiment according to the present invention.

Referring now to FIG. 4, there is shown a transistor switching circuit of the first embodiment according to the present invention. As shown in FIG. 4, an Up-switch (SW1) is connected in parallel with a line applied input power of a plate (B+). The Up-switch (SW1) has two fixed contacts (FIG. 3), one of which is connected to the line applied input power of a plate (B+) and the other of which is connected in parallel with resistances R1 and R2. A resistance R1 connects to the collector of a guard transistor Q12 and to the base of a switching transistor Q1. The collector of the switching transistor Q1 is connected through a resistance R3 to the line of a plate (B+), and the output terminal of the switching transistor Q1 is connected to the base of a transistor Q9 so as to apply a bias power and also connected through a resistance R4 to ground.

The collector of a transistor Q9 is connected through a resistance R6 to the line of a plate (B+), and the emitter of a transistor Q9 is connected to the base of a driving transistor Q6. The emitter of a driving transistor Q3, operating point symmetrically, is connected to the line of a plate (B+), and the base is connected to the emitter of a transistor Q7. The base of a transistor Q7 is connected through a diode D1 to the collector of a switching transistor Q1 in parellel with a resistance R3 and the output of a transistor Q7 is connected through a resistance R5 to ground. An output terminal is led from the collector of a driving transistor Q3, operating point symmetrically, and from the collector of a driving transister Q6. DC moter (M), which is a load, is connected between point C in the lead from the collector of a transistor Q3 and point D in the lead from the collector a transistor Q6. Power of a plate (B+) is applied through a resistance R2 to the base of a guard transistor Q11 and the collector of guard transitor Q11 is connected to the base of a switching transistor Q2, and the emitter of a guard transistor Q11 is connected to ground. And as shown in FIG. 4 the circuitry of the present invention is constructed as two parts, one of which is Up circuitry 10, and the other of which is Down circuitry 11 that is symmertical to Up Circuitry 10.

Figure 7:
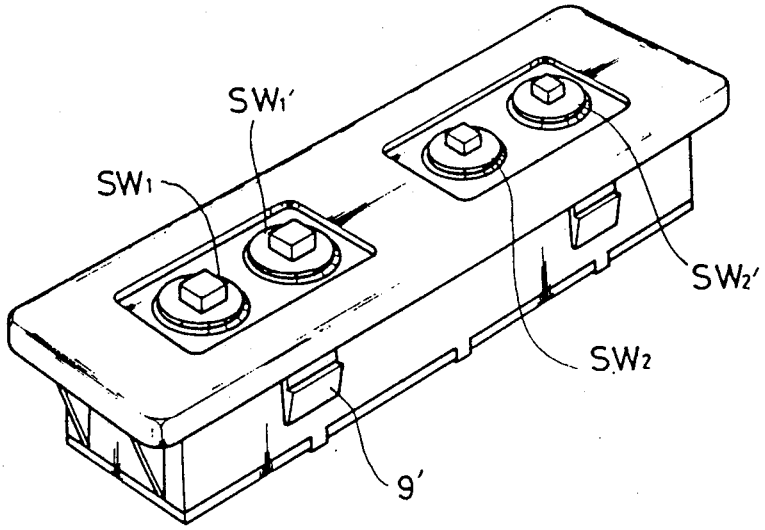
FIG. 7 and FIG. 8 illustrate a second embodiment according to the present invention.
Figure 8:
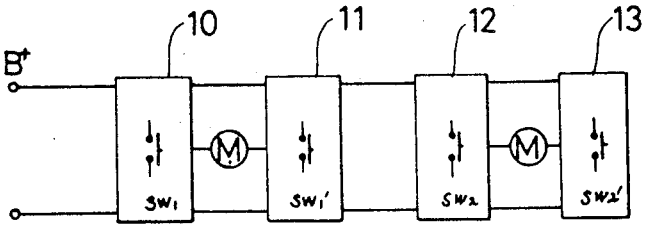

FIGS. 7 and 8 the second embodiment according to the present invention. Referring to FIG. 8, circuitry 12 and 13 having the same, construction as the above basic circuitry 10 and 11 which is Up-Down circuitry is connected to circutry 10 and 11, and DC motor (M), which is a load, is connected in parallel with an input line.

Figure 9:
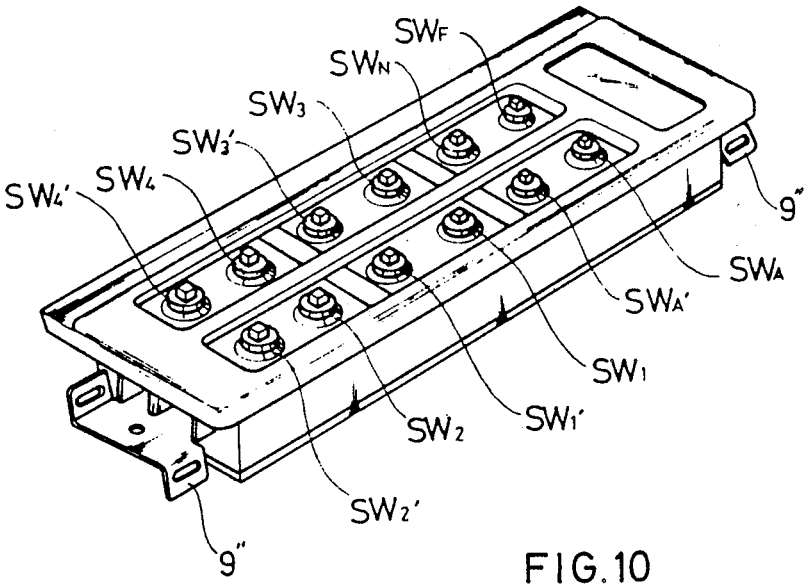
FIG. 9 and FIG. 10 illustrate a third embodiment according to the present invention.
Figure 10:
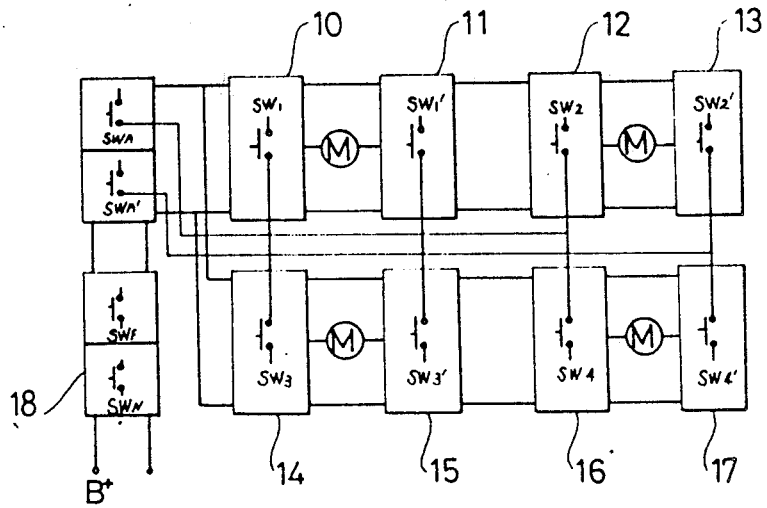

While FIGS. 9 and 10 show the third embodiment of the present invention. Referring to FIG. 10, there are four pairs of circuitries 10, 11; 12, 13; 14, 15; and 16, 17 having the same construction as the basic circuitry 10 and 11 which is Up-Down circuitry as shown in FIG. 4, and they are all connected in parallel with a power source. The second fixed contacts of Up switches SW1, SW2, SW3, SW4 are connected in parallel with Auto Up switch SWA, and the first fixed contacts thereof are connected to the line of a plate (B+) of power source. The second contacts of Down switches SW1', SW2', SW3', SW4' are connected in paralled with Auto Down switch SWA' and the first fixed contacts thereof are connected in parallel with the line of a plate (B+) of power source. And an ordinary On-Off circuitry 18, which can make and brake main power (B+) at the front pitch of Auto Up-Down switches $SW_A$, $SW_A'$, is connected in series with power source.

To the next, mechanical construction of the present invention will be explained.

Referring to FIG. 3, there extend a number of terminals 8 (One shown) from the base of a printed circuit board (PCB) 7 which arranges a transistor switch circuitry 10 and 11. On an upper fixed contact plate 6, there is formed a fixed contact 6' which is contacted pressedly with a conductive rubber contact 5 heat-fused on the upper inside of a resin wall 1' and the conductive rubber contact 5 is arranged to oppose the upper fixed contact plate 6. Homogeneous resin wall 1' covers the PCB 7 and the upper fixed contact plate 6 ranging from the sides of the PCB 7 through the side to the upper part of a switch body 1, and the base of the PCB is epoxy coated by the conventional method. Through the upper part of the resin wall 1' buttons 4 and 4' are established in one body thus exercising a pressure on the conductive rubber contact 5, and at the lower part of buttons 4 and 4' an elastic slope 4 is formed round thus enabling pressed contact 5 to return to the original position by elasticity. As described hereinabove a switch body 1 comprises a PCB 7, a number of terminals 8 extending from said PCB 7, a fixed contact 6' an upper fixed contact plate 6, buttons 4 and 4', a conductive rubber contact 5 on the base of said buttons 4 and 4', an elastic slope 4'', and a resin wall 1'. And an upper switch case 2 carries the switch body 1 so as to protrude buttons 4 and 4' through an upper open portion 2' of the upper switch case 2, and a lower switch plate 3 having a number of terminal apertures 8' is established on the lower part of the upper switch case 2.

Figure 11:
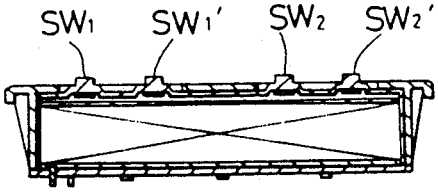
FIG. 11 is a partial, cross-sectional, side, elevational view of the second embodiment according to the present invention.
Figure 12:
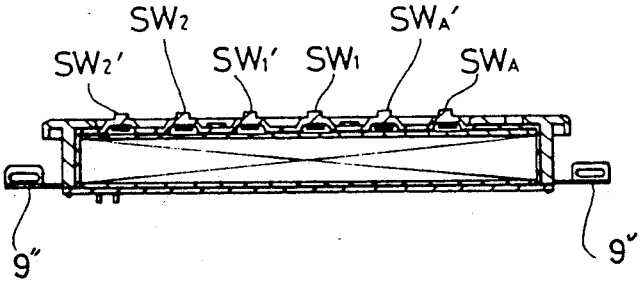
FIG. 12 is a partial, cross-sectional, side, elevational view of the third embodiment according to the present invention.

Referring to FIG. 7 and FIG. 9, other embodiments of the present invention are shown. They apply the above basic illustration, i.e., a few of the above constructions are formed in one arrangement (as shown in FIG. 11) and 12.

Unexplained components are fastners 9,9' and 9'' which fasten a power window switch to a car and a power break switch $SW_F$, and a power make switch $SW_N$.

Afterwards the operation of the above mentioned construction will be described in detail.

Referring to FIG. 3 and FIG. 4, when a user wants to lift the window of an automobile, first he must push the button 4. Then the conductive rubber contact 5 descends to contact the fixed contact 6' on the upper fixed contact plate, and thereby the contacts of Up switch SW 1, close. By this power source applied to the line of a plate (B+) is applied to resistances R1 and R2 and power source through the resistance R1 applies a bias power to the base of the switching transister Q1 so the switching transistor Q1 turns on. The output of the switching transistor Q1 is applied to the base of the transistor Q9 so as to apply a bias voltage to the transistor Q6 positioned point symmetrically. In the illustration of the present invention the switching transistor Q1 and the transistor Q9 operate as a kind of darlington circuit. When the output of the transistor Q9 is applied to the driving transistor Q6, the driving transistor Q6 turns on and simultaneously the transistor Q3 is biased, through the transistor Q7 and the diode D1 connected with a switching transistor Q1, to be activated.

As it were, point symmetrically driving transistor Q3 and Q6 conduct simultaneously by turn-on of the switching transistor Q1. This constructs a closed circuit starting from point A through the driving transistor Q3, point C, DC motor M, point D, and the driving transistor Q6 and ending in ground F, and also rotates DC motor. When DC motor drives, gear, threaded with gear of DC motor (unshown in FIGS. ) drive to lift a window. While when a user wants to stop lifting a window at an desirable position he releases the pressure on the button 4. This causes a bias power applied to the switching transistor Q1 to be turned off and at the same time transistors Q3, Q6, Q7, Q9 and Q11 are turned off, and then the above closed circuit is open to stop driving DC motor and lifting a window.

Reversely, when a user wants to descend a window, he pushes the button 4' at the opposite side of the button 4. Then the same operation as the above described lifting operation occurs in the down circuitry 11 connected symmetrically with the up circuitry 10. As it were, a driving circuit of DC motor is constructed starting from point B through the driving transistor Q4, point D, DC motor M, point C, and the driving transistor Q5, and ending in point E so DC motor rotates reverse. This causes a window to be descended.

While in the case of operating both the up switch SW1 and down switch $SW_{1'}$ by the carelessness of a user, guard transistors Q11 and Q12 applied bias power is activated and operate earth. By this earth operation input power applied to the base of switching transistor Q1 and Q2 becomes insufficient to bias the switching transistors Q and Q2 and a pair of point symmetrically driving transistors (Q3, Q6) and (Q4, Q5) are maintained in a turn-off state. Therefore when a user operates buttons SW1 and $SW_{1'}$ at the same time driving transistors Q3, Q4, Q5, and Q6 do not activate so DC motor does not operate.

In the second embodiment of the present invention as shown in FIG. 7 Up-Down circuitry 12 and 13 having the same the same constrution as the Up-Down circuitry 10 and 11 above mentioned is connected to a power source in parallel with the Up-Down circuitry 10 and 11. This case is adaped to an automobile having two door by operating two switching circuitries which work seperately.

In the third embodiment of the present invention as shown in FIG. 9 and FIG. 10, four pairs of circuitries 10, 11; 12, 13; 14, 15; and 16, 17 having the same construction as the basic circuitry 10 and 11 above mentioned are connected to a power source in parallel with one another, and these four circuitries operate separately. And furthermore by connecting the second fixed contact of each switch in parallel with the second fixed contact of Auto switches $SW_A$ and $SW_{A'}$, an operation of one of the Auto switches SWA and SWA' enables all the four windows to work at the same time. The operating mode of this case is the same as that of the basic circuitry 10 and 11, but the difference is that Auto Up-Down switches $SW_A$ and $SW_{A'}$ maintain contact.

In FIG. 10 an ordinary On-Off circuitry 18 connected in parallel with power input side of the front pitch of said Auto switch $SW_A$ and $SW_{A'}$ controls input of operating power source, and this enables power window switches for an automobile to be concentrated at the center and all the windows to work by operating one switch.

Figure 5:
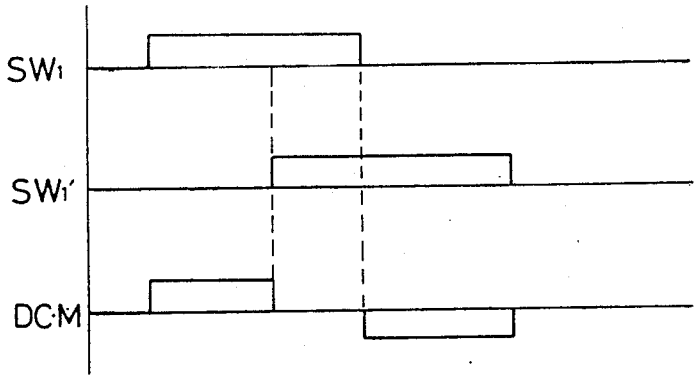
FIG. 5 and FIG. 6 are time charts showing the relation between the operation of switches and drive of a motor.

The relation between the operation of switches and the drive of a motor hereinabove mentioned can be easily understood by referring to the time charts shown in FIG. 5 and FIG. 6. As shown in FIG. 5 maintaining contact by pressing Up switch SW1 makes DC motor rotate, and operating Down switch $SW_{1'}$ simultaneously with operation of Up switch SW1 by the carelessness of a user makes driving transistors Q3, Q4, Q5, and Q6 turn off through earth operation of guard transistors Q11 and Q12. Therefore when the two switch operate at the same time DC motor does not rotate. And by the release of contact state of Up switch SW1 in the course of pressing two switches, a guard transistor Q11 turns off and continuosly pressed Down switch $SW_{1'}$ operates. This operation makes DC motor rotate reversely.

Figure 6:
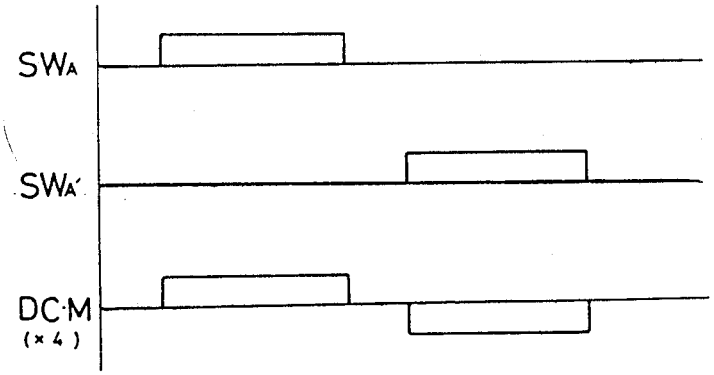

In FIG. 6 an operation of four DC motors by Auto Up-Down switches $SW_A$ and $SW_{A'}$ is shown. This phenomenon is resulted from operating respective DC motors in parallel.

While buttons 4 and 4', extending above the upper port of a resin wall 1' in one body, have an elastic slope 4'' and thus return to their original position by their own elasticity when pressed. This elasticity makes the feeling of operation admirable. Also, by using the present switching circuit in place of a make and break load/-transistor switching circuit, the amount of current applied to the contact points is reduced to minute. Therefore, arc discharge (occuring by an initial amount in rush of electricity when DC motor drives) can be prevented, and also damage of contacts can be prevented. Furthermore the damage of the fixed contact 6' can be prevented because of smooth surface of the conductive rubber contact 5 which is a traveling contact. As well known in the case of a power window switch for an automobile having mechanical contact, a life of a switch is short, i.e., about 5,000 times operating capability of make and break, due to an arc discharge occurring at the initial operation and limitation of the elasticity of a spring, etc. But a power window switch of the present invention has a long life, i.e. about 1–10 million times of make and break, therefore it is a semipermanant power window switch. And guard of interior circuit components by a resin wall 1' prevents any detrimental influence due to moisture penetrating the contacts and switching circuit.

Although the invention has been described hereinabove with reference to the preferred embodiments, it will be appreciated that many variations and modifications may be made without departing from the spirit and scope of the invention. For example the switch of the present invention may be applied to an antena of an automobile, an air conditioner, and so on.

What is claimed is:

1. A power window switch for an automobile, comprising:

a printed circuit board which includes a switching circuit;

a casing secured to said circuit board;

a contact plate which includes a first fixed contact, and said contact plate being secured within said casing;

a first button which includes an elastic slope portion, said elastic slope portion secured to said casing;

a first conductive rubber contact secured to a surface of said button, and said first button being positioned with respect to said first fixed contact such that, when said elastic slope portion is in a non-compressed state, said first conductive rubber contact is in a spaced relationship with said first fixed contact and when said elastic slope portion is in a compressed state said first conductive rubber contact is in contact with said first fixed contact; and said switching circuit including a first up-circuit comprised of an up-switch, said up-switch including said first fixed contact, and said first fixed contact including two first fixed contact points one of which is connected to an input power source line the other of which is connected in parallel with a first resistance (R1) and a second resistance (R2), said first resistance (R1) being connected to the collector of a first transistor (Q12) and the base of a second transistor (Q1), the collector of said second transistor (Q1) being connected through a third resistance (R3) to the input power source line, the output terminal of said second transistor (Q1) being connected to the base of a third transistor (Q9) so as to apply a bias power and also through a fourth resistance (R4) to ground, the collector of said third transistor (Q9) being connected through a fifth resistance (R6) to the input power source line, and the emitter of said third transistor (Q9) being connected to the base of a fourth transistor (Q6), the emitter of a fifth transistor (Q3), operating point symmetrically, being connected to the input power source line and the base of said fifth transistor (Q3) being connected to the emitter of a sixth transistor (Q7), the base of said sixth transistor (Q7) being connected through a first diode to the collector of said second transistor (Q1) in parallel with said third resistance (R3), and the output of said sixth transistor (Q7) being connected through a sixth resistance (R5) to ground, a first load line extending from the collector of said fifth transistor (Q3), a second load line extending from the collector of said fourth transistor (Q6), a load connected between a first point on said first load line and a second point on said second line, said second resistance (R2) connected at one end to said input power source line and at the other end to the base of a seventh transistor (Q11), the collector of said seventh transistor (Q11) being connected to the base of an eighth transistor (Q2) and the emitter of said seventh transistor (Q11) being connected to ground.

2. A switch as recited in claim 1, wherein said casing includes resinous side walls extending off of said circuit board and a resinous upper wall integrally joined with said side walls, said elastic slope portion having a free edge secured about a port formed in said upper wall and said fixed contact positioned below the port formed in said upper wall such that when said elastic slope portion is compressed said button extends through the hole in said upper wall and said conductive rubber contact is placed into contact with said fixed contact.

3. A power window switch as recited in claim 1, further comprising a second button which includes an elastic slope portion secured to said casing; a second conductive rubber contact secured to said second button, and said contact plate including a second fixed contact plate with said second button being positioned with respect to said second fixed contact such that, when the elastic slope portion of said second button is in a non-compressed state, said second conductive rubber contact is in a spaced relationship with said second fixed contact and when said elastic slope portion of said second button is in a compressed state said second conductive rubber contact is in contact with said second fixed contact.

4. A power window switch as recited in claim 3, wherein said switching circuit further includes:

a first down-circuit comprised of a down-switch, said down-switch including said second fixed contact, and said second fixed contact including two second fixed contact points, one of which is connected to the input power source line the other of which is connected in parallel with a seventh resistance (R11) and an eighth resistance (R12), said seventh resistance (R11) being connected to the collector of said seventh transistor (Q11) and the base of said eighth transistor (Q2), the collector of said eighth transistor (Q2) being connected through a ninth resistance (R10) to the input power source line, the emitter of said eight transistor (Q2) being connected to the base of a ninth transistor (Q10) and also through a tenth resistance (R9) to ground, the collector of said ninth transistor (Q10) being connected through an eleventh resistance (R7) to the input power source line, and the emitter of said ninth transistor (Q10) being connected to the base of a tenth transistor (Q5), the collector of an eleventh transistor (Q4) being connected to the input power source line, and the base of said eleventh transistor (Q4) being connected to the collector of a twelfth transistor (Q8), the base of said twelfth transistor (Q8) being connected through a second diode to the collector of said eight transistor (Q2) in parallel with said ninth resistance (R10), and the output of said twelfth transistor (Q8) being connected through a twelfth resistance (R8) to ground, a third load line extending from the emitter of said eleventh transistor (Q4) and a fourth load line extending from the collector of said tenth transistor (Q5), said load being in connection between said third and fourth load lines.

5. A power window switch as recited in claim 4, wherein said load includes an electric motor.

6. A power window switch as recited in claim 4, further comprising a second pair of said first and second buttons and a second up-circuit connected to said input power source line, and a second down- circuit connected to said input power source line, said buttons being positioned such that compression of the elastic slope portion of each button results in contact between one of said conductive rubber contacts and one of said first and second fixed contacts.

7. A power window switch as recited in claim 6, further comprising a third and fourth pair of said first and second buttons and said switching circuit further including third and fourth up-circuits and third and fourth down-circuits, said up-circuits and said down-circuits being arranged in parallel and in connection with said input power source line.

8. A power window switch as recited in claim 7, wherein each pair of said up-circuits and said down-circuits includes a load and each of said pairs of up-circuits and down-circuits are adapted to operate independently of one another.

9. A power window switch as recited in claim 8, further comprising a fifth up-circuit and a fifth down-circuit, and said fixed contact points of each of said up-circuits and down-circuits, which are not connected with said power source line, being connected together in parallel.

10. A power window switch as recited in claim 9, further comprising on-off circuitry connected in series with said input power source line.

11. A power window switch as recited in claim 4, wherein said switching circuitry includes means for preventing operation of said electric motor when said first and second conductive rubber contacts are simultaneously in contact with said first and second fixed contacts.

12. A power window switch comprising:

a switching circuit which includes;

a first up-circuit comprised of an up-switch, said up-switch including a first fixed contact, and said first fixed contact including two first fixed contact points one of which is connected to an input power source line the other of which is connected in parallel with a first resistance (R1) and a second resistance (R2), said first resistance (R1) being connected to the collector of a first transistor (Q12) and the base of a second transistor (Q1), the collector of said second transistor (Q1) being connected through a third resistance (R3) to the input power source line, the output terminal of said second transistor (Q1) being connected to the base of a third transistor (Q9) so as to apply a bias power and also through a fourth resistance (R4) to ground, the collector of said third transistor (Q9) being connected through a fifth resistance (R6) to the input power source line, and the emitter of said third transistor (Q9) being connected to the base of a fourth transistor (Q6), the emitter of a fifth transistor (Q3), operating point symmetrically, being connected to the input power source line and the base of said fifth transistor (Q3) being connected to the emitter of a sixth transistor (Q7), the base of said sixth transistor (Q7) being connected through a first diode to the collector of said second transistor (Q1) in parallel with said third resistance (R3), and the output of said sixth transistor (Q7) being connected through a sixth resistance (R5) to ground, a first load line extending from the collector of said fifth transistor (Q3), a second load line extending from the collector of said fourth transistor (Q6), a load connected between a first point on said first load line and a second point on said second line, said second resistance (R2) connected at one end to said input power source line and at the other end to the base of a seventh transistor (Q11), the collector of said seventh transistor (Q11) being connected to the base of an eight transistor (Q2) and the emitter of said seventh transistor (Q11) being connected to ground.

13. A power window switch as recited in claim 12, wherein said switching circuit further includes:

a first down-circuit comprised of a down-switch, said down-switch including a second fixed contact, and said second fixed contact including two second fixed contact points, one of which is connected to the input power source line the other of which is connected in parallel with a seventh resistance (R11) and an eighth resistance (R12), said seventh resistance (R11) being connected to the collector of said seventh transistor (Q11) and the base of said eighth transistor (Q2), the collector of said eighth transistor (Q2) being connected through a ninth resistance (R10) to the input power source line, the emitter of said eight transistor (Q2) being connected to the base of a ninth transistor (Q10) and also through a tenth resistance (R9) to ground, the collector of said ninth transistor (Q10) being connected through an eleventh resistance (R7) to the input power source line, and the emitter of said ninth transistor (Q10) being connected to the base of a tenth transistor (Q5), the collector of an eleventh transistor (Q4) being connected to the input power source line, and the base of said eleventh transistor (Q4) being connected to the collector of a twelfth transistor (Q8), the base of said twelfth transistor (Q8) being connected through a second diode to the collector of said eight transistor (Q2) in parallel with said ninth resistance (R10), and the output of said twelfth transistor (Q8) being connected through a twelfth resistance (R8) to ground, a third load line extending from the emitter of said eleventh transistor (Q4) and a fourth load line extending from the collector of said tenth transistor (Q5), said load being in connection between said third and fourth load lines.

* * * * *